US009289914B2

(12) United States Patent
Ueda et al.

(10) Patent No.: US 9,289,914 B2
(45) Date of Patent: Mar. 22, 2016

(54) IMAGE FORMING APPARATUS AND CUTTING DEVICE

(75) Inventors: Masaharu Ueda, Tokyo (JP); Akio Okubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 694 days.

(21) Appl. No.: 12/965,724

(22) Filed: Dec. 10, 2010

(65) Prior Publication Data

US 2011/0211900 A1 Sep. 1, 2011

(30) Foreign Application Priority Data

Feb. 26, 2010 (JP) ..... 2010-041662

(51) Int. Cl.

| | |
|---|---|
| ***B65H 35/04*** | (2006.01) |
| ***B41J 11/70*** | (2006.01) |
| ***B26D 5/34*** | (2006.01) |
| ***B26D 1/09*** | (2006.01) |
| ***B41J 11/66*** | (2006.01) |
| ***B65H 35/06*** | (2006.01) |

(52) U.S. Cl.

CPC *B26D 5/34* (2013.01); *B26D 1/095* (2013.01); *B41J 11/663* (2013.01); *B41J 11/70* (2013.01); *B65H 35/06* (2013.01); *B65H 2301/51212* (2013.01); *B65H 2301/515326* (2013.01); *B65H 2404/14* (2013.01); *B65H 2513/40* (2013.01); *B65H 2801/12* (2013.01); *B65H 2801/24* (2013.01)

(58) Field of Classification Search

CPC ..... B26D 1/095; B26D 5/34; B41J 11/663; B41J 11/70; B65H 35/06; B65H 2801/24; B65H 2801/12; B65H 2404/14; B65H 2220/09; B65H 2301/51212; B65H 2301/515326; B65H 2513/40

USPC ..... 400/621

See application file for complete search history.

(56) References Cited

U.S. PATENT DOCUMENTS

| | | | | |
|---|---|---|---|---|
| 6,190,066 | B1 * | 2/2001 | Ishigouoka et al. | 400/120.01 |
| 6,869,039 | B2 * | 3/2005 | Koutonen | 242/524.1 |
| 8,408,825 | B2 * | 4/2013 | Gocho | 400/76 |

FOREIGN PATENT DOCUMENTS

| | | | |
|---|---|---|---|
| CN | 1202425 | A | 12/1998 |
| EP | 1908597 | A1 | 4/2008 |
| JP | 60-137765 | A | 7/1985 |
| JP | 07-304220 | A | 11/1995 |
| JP | 2001-105383 | A | 4/2001 |
| JP | 2001-310849 | A | 11/2001 |

(Continued)

*Primary Examiner* — Jill Culler
*Assistant Examiner* — Marissa Ferguson Samreth
(74) *Attorney, Agent, or Firm* — Canon USA, Inc., IP Division

(57) ABSTRACT

An image forming apparatus includes a first conveying unit provided downstream an image forming unit; a second conveying unit provided downstream the first conveying unit; a first cutting unit provided downstream the second conveying unit; and a second cutting unit provided downstream the first cutting unit. One of the first and second cutting units cuts an upstream end of an image on the continuous sheet, the other cuts a downstream end of the same image. The second conveying unit is stopped during the cutting by the first cutting unit to form a loop of the continuous sheet, and then if the cutting is ended, the second conveying unit conveys the continuous sheet at a higher conveyance speed than a conveyance speed by the first conveying unit to reduce the loop.

7 Claims, 15 Drawing Sheets

(56) References Cited

FOREIGN PATENT DOCUMENTS

| | | | | | |
|---|---|---|---|---|---|
| JP | 2003-54044 | * | 2/2003 | ..... | B41J 3/54 |
| JP | 2003-211755 | A | 7/2003 | | |
| JP | 2009-233915 | A | 10/2009 | | |

* cited by examiner

IMAGE FORMING APPARATUS AND CUTTING DEVICE

BACKGROUND OF THE INVENTION

1. Field of the Invention

The present invention relates to an image forming apparatus that continuously forms images on a continuous sheet and includes a cutting unit for cutting the continuous sheet in accordance with an image length, and to a cutting device.

2. Description of the Related Art

Japanese Patent Laid-Open No. 2003-211755 discloses a printing apparatus that continuously prints a plurality of images on a continuous sheet, simultaneously cuts the continuous sheet at positions between the images by two cutters, and forms printouts without a margin.

With the printing apparatus disclosed in Japanese Patent Laid-Open No. 2003-211755, the positions of the two cutters are fixed, and hence the distance between images has to be constant.

Meanwhile, an inkjet recording apparatus has to discharge ink for refreshing on a non-image portion located between images in order to prevent ink located near an ink discharge portion from being dried. In addition, a pattern for inspecting whether nozzles are capable of discharging ink or not, or a pattern for detecting whether an image has a defect, has to be recorded at irregular timing. In the state in which the distance between images is fixed like Japanese Patent Laid-Open No. 2003-211755, if the distance between images is increased to record the aforementioned pattern at irregular timing, the sheet may be wasted. If the distance between images is decreased, the pattern cannot be recorded at desirable timing.

SUMMARY OF THE INVENTION

The present invention allows continuous high-speed printing to be performed even if conveyance of a continuous sheet is stopped while the continuous sheet is cut, and the present invention decreases a loop of the continuous sheet that is generated when the continuous sheet is cut.

An image forming apparatus according to an aspect of the present invention includes an image forming unit arranged to continuously form images on a continuous sheet; a first conveying unit provided downstream the image forming unit in a conveyance direction and arranged to continuously convey the continuous sheet with the images formed thereon; a second conveying unit provided downstream the first conveying unit in the conveyance direction and arranged to convey the continuous sheet; a first cutting unit provided downstream the second conveying unit in the conveyance direction and arranged to cut the continuous sheet; a second cutting unit provided downstream the first cutting unit in the conveyance direction and arranged to cut the continuous sheet; and a control unit arranged to perform control such that one of the first and second cutting units cuts an upstream end in the conveyance direction of an image on the continuous sheet, the other cuts a downstream end in the conveyance direction of the same image, the second conveying unit is stopped during the cutting by the first cutting unit to form a loop of the continuous sheet at a position between the first and second conveying units, and then if the cutting is ended, the second conveying unit conveys the continuous sheet at a higher conveyance speed than a conveyance speed by the first conveying unit to reduce the loop.

A cutting device according to another aspect of the present invention includes a first conveying unit arranged to continuously convey a continuous sheet; a second conveying unit provided downstream the first conveying unit in a conveyance direction and arranged to convey the continuous sheet; a first cutting unit provided downstream the second conveying unit in the conveyance direction and arranged to cut the continuous sheet; a second cutting unit provided downstream the first cutting unit in the conveyance direction and arranged to cut the continuous sheet; and a control unit arranged to perform control such that one of the first and second cutting units cuts an upstream end in the conveyance direction of an image on the continuous sheet, the other cuts a downstream end in the conveyance direction of the same image, the second conveying unit is stopped during the cutting by the first cutting unit to form a loop of the continuous sheet at a position between the first and second conveying units, and then if the cutting is ended, the second conveying unit conveys the continuous sheet at a higher conveyance speed than a conveyance speed by the first conveying unit to reduce the loop.

With the aspect of the present invention, the continuous high-speed printing can be performed even if the conveyance of the continuous sheet is stopped while the continuous sheet is cut. Also, the loop of the continuous sheet generated when the continuous sheet is cut can be reduced.

Further features of the present invention will become apparent from the following description of exemplary embodiments with reference to the attached drawings.

DESCRIPTION OF THE EMBODIMENTS

First Embodiment

An image forming apparatus according to a first embodiment of the present invention will be described below with reference to the attached drawings.

Figure 1:
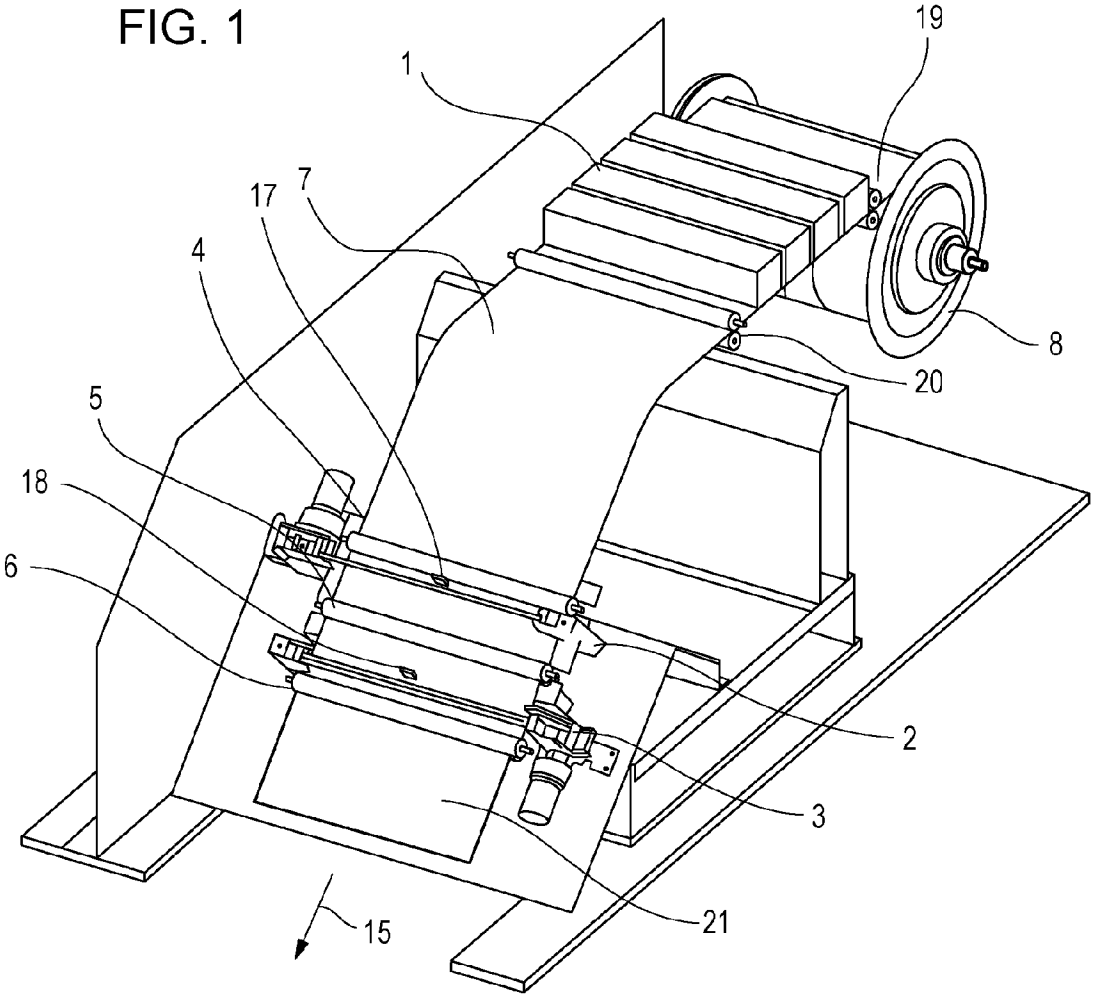
FIG. 1 is a perspective view showing the overview of an image forming apparatus including an image forming unit according to a first embodiment of the present invention.

Referring to FIG. 1, a continuous sheet 7 fed from a continuous sheet feeding unit 8 is conveyed by a first main conveying roller pair 19 such that the continuous sheet 7 passes through an image forming unit 1 provided downstream the first main conveying roller pair 19 in a conveyance direction 15. A second main conveying roller pair 20 (first conveying unit) is provided downstream the image forming unit 1. The second main conveying roller pair 20 conveys the continuous sheet 7 from the image forming unit 1 to a cutting device.

The image forming unit 1 includes recording heads that discharge ink of respective colors and are arranged in the conveyance direction. The recording heads are arranged for cyan, magenta, yellow, and black. Each recording head has a plurality of discharge nozzles to cover an entire width of the continuous sheet 7 so that the recording head can discharge ink for the entire width of the continuous sheet 7.

The recording head discharges ink, in accordance with image information, on the continuous sheet 7 that is continuously conveyed at a constant speed by the first main conveying roller pair 19 and the second main conveying roller pair 20, to successively form a plurality of images. The image forming unit 1 of the apparatus employs an inkjet recording method. The image forming unit 1 successively discharges ink of cyan, magenta, yellow, and black at a constant frequency without color misregistration. To obtain a fine (good quality) image, the continuous sheet 7 has to be conveyed at a constant printing conveyance speed Va. If the speed becomes lower than the printing conveyance speed Va, an image during image formation becomes a defective image. If the defective image is formed, the continuous sheet 7 during image formation has to be thrown away. This may increase running cost. In addition, printing has to be performed from the beginning again. This may reduce productivity.

Figure 2A:
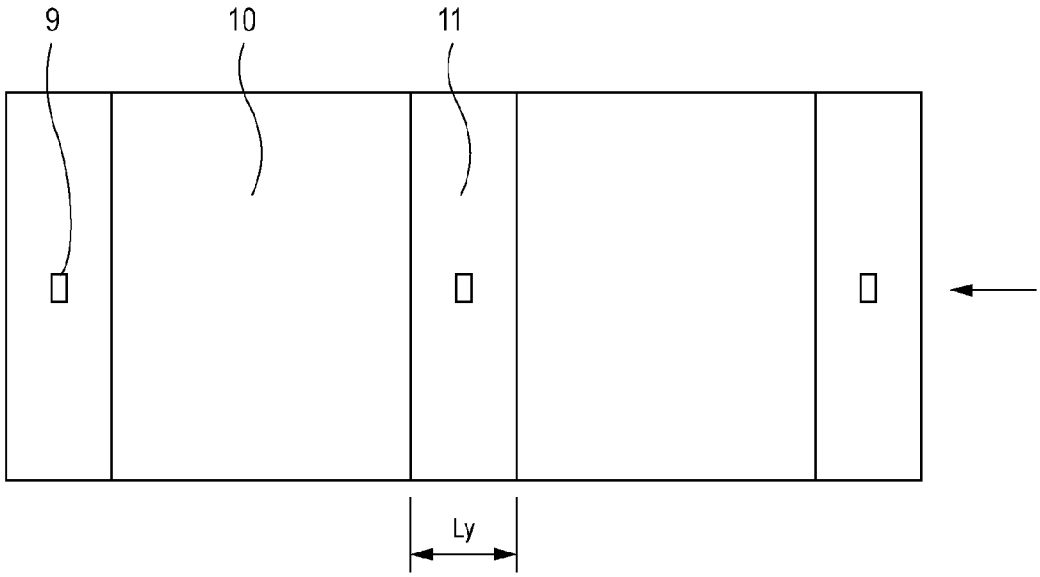
FIGS. 2A and 2B each illustrate a printed state of an image, a non-image, and a cutting mark, which are printed by the image forming unit according to the first embodiment.

A blank portion (non-image portion) is formed between images because ink is not discharged on that portion. Referring to FIG. 2A, the image forming unit 1 alternately forms an image portion 10 and a non-image portion 11 on the continuous sheet 7. Also, a cutting mark 9 is printed on the non-image portion 11. The cutting mark 9 includes a record of cutting-position information for cutting by the cutting device. In this embodiment, the cutting mark 9 serves as a reference for determining a cutting position. Also, refreshing is performed by discharging ink, which is located near discharge ports of the discharge nozzles of the image forming unit 1 and has a high viscosity, on the non-image portion 11 at a predetermined time interval. Further, a pattern for inspecting whether nozzles that discharge ink are capable of discharging ink or not, or a pattern for inspecting whether an image has a defect or not, is recorded at irregular timing. When refreshing is performed or a pattern is recorded, the non-image portion 11 may become long. Even in this case, the cutting mark 9 specifies the cutting position.

Figure 2B:
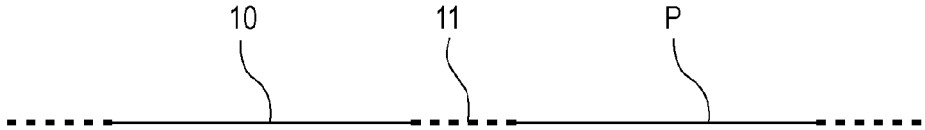

In FIG. 2A, Ly is a length of the non-image portion 11. FIG. 2B is a schematic view from a side of the continuous sheet 7 shown in FIG. 2A. The image portion 10 is indicated by a solid line, and the non-image portion 11 is indicated by a broken line. The cutting mark 9 is provided on a side P of the broken line indicative of the non-image portion 11.

The cutting device includes a first cutter 2 (first cutting unit) provided downstream of the second main conveying roller pair 20, and a second cutter 3 (second cutting unit) provided downstream of the first cutter 2.

Figure 5A:
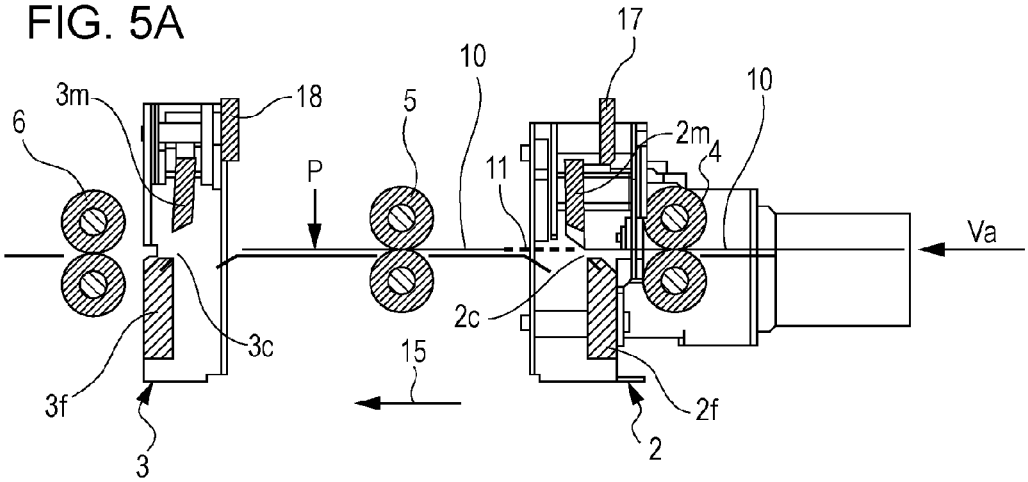
FIGS. 5A to 5C are explanatory views showing an operation of a cutting device.

The first cutter 2 includes a movable blade 2*m* (first blade) and a fixed blade 2*f* (second blade). The continuous sheet 7 is cut when the movable blade 2*m* reciprocates in an up-down direction as shown in FIG. 5A. The second cutter 3 includes a movable blade 3*m* and a fixed blade 3*f* and has a configuration similar to the configuration of the first cutter 2. When the continuous sheet 7 passes through the first cutter 2, the movable blade 2*m* and the fixed blade 2*f* are separated from each other. In the first cutter 2, the fixed blade 2*f* is arranged at the upstream side in the conveyance direction, so in the direction 15 for the continuous sheet 7 (shown in FIG. 5A), and the movable blade 2*m* is arranged at the downstream side in the conveyance direction. Referring to FIG. 5A, a printed surface of the continuous sheet 7 is the side P. The fixed blade 2*f* is constantly located closer to an image than the movable blade 2*m*, but the fixed blade 2*f* contacts a surface opposite the printed surface with an image. The movable blade 2*m* contacts the printed surface with an image, but the surface is the non-image portion 11.

Hence, if the first cutter 2 is continuously operated, a dye component or a pigment component contained in the ink on the printed surface that adheres to the movable blade 2*m* and is transferred again onto the continuous sheet 7 during next cutting, the dye component or the pigment component is transferred on the non-image portion 11. The quality of an image on the printed surface is thus not degraded.

A control unit (see description of FIG. 3 below) desirably includes a movable blade position sensor (not shown) and a movable blade actuator (cutter motor) whose driving is controlled in accordance with detection data of the movable blade position sensor. A control unit similar to the control unit for the first cutter 2 is provided for the second cutter 3.

First and second mark sensors 17 and 18 detect the cutting mark 9. The first cutter 2 includes the first mark sensor 17, and the second cutter 3 includes the second mark sensor 18. The first and second mark sensors 17 and 18 employ reflection-type sensors using photoelectric conversion. If the first and second mark sensors 17 and 18 detect the cutting mark 9, the continuous sheet 7 is conveyed by a predetermined distance and stopped. Then, the continuous sheet 7 is cut.

A first conveying roller pair 4 (second conveying unit) that conveys the continuous sheet 7 is arranged between the second main conveying roller pair 20 and the first cutter 2. A second conveying roller pair 5 is arranged between the first cutter 2 and the second cutter 3. A third conveying roller pair 6 (third conveying unit) is provided downstream of the second cutter 3.

Figure 3:
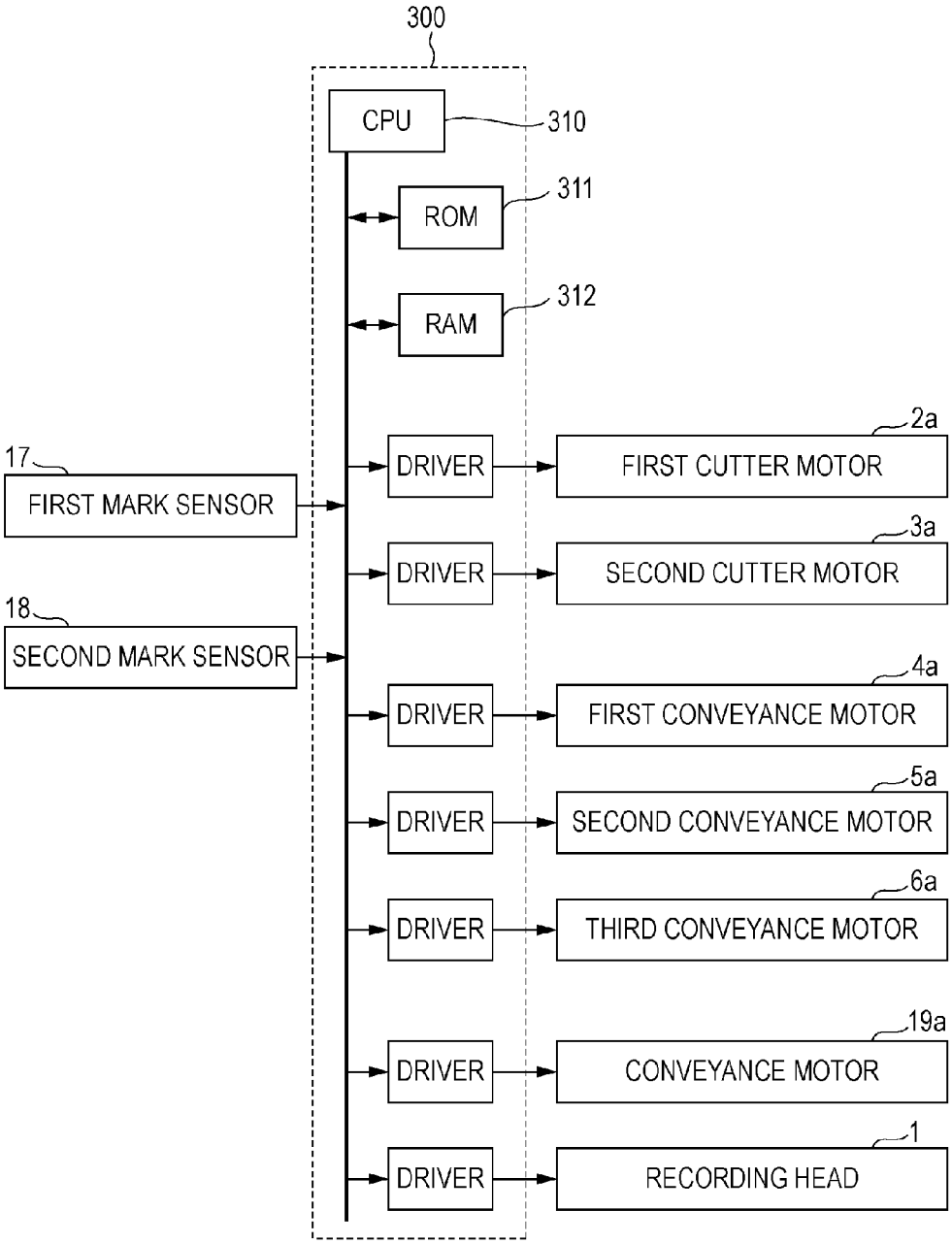
FIG. 3 is a circuit block diagram of the image forming apparatus.

FIG. 3 is a control block diagram showing the image forming apparatus. A control circuit 300 (control unit) includes a CPU 310, a ROM 311, and a RAM 312. The CPU 310 makes an instruction and a determination for control. The ROM 311 stores a program and a control table. The RAM 312 temporarily stores image information and control information. The control circuit 300 also includes drivers that drive various motors and heads.

A first cutter motor 2*a* drives the first cutter 2. A second cutter motor 3*a* drives the second cutter 3. A first conveyance motor 4*a* drives a driving roller of the first conveying roller pair 4. A second conveyance motor 5*a* drives a driving roller of the second conveying roller pair 5. A third conveyance motor 6*a* drives a driving roller of the third conveying roller pair 6. Conveyance motor 19*a* drives the first main conveying roller pair 19 and the second main conveying roller pair 20.

Figure 4:
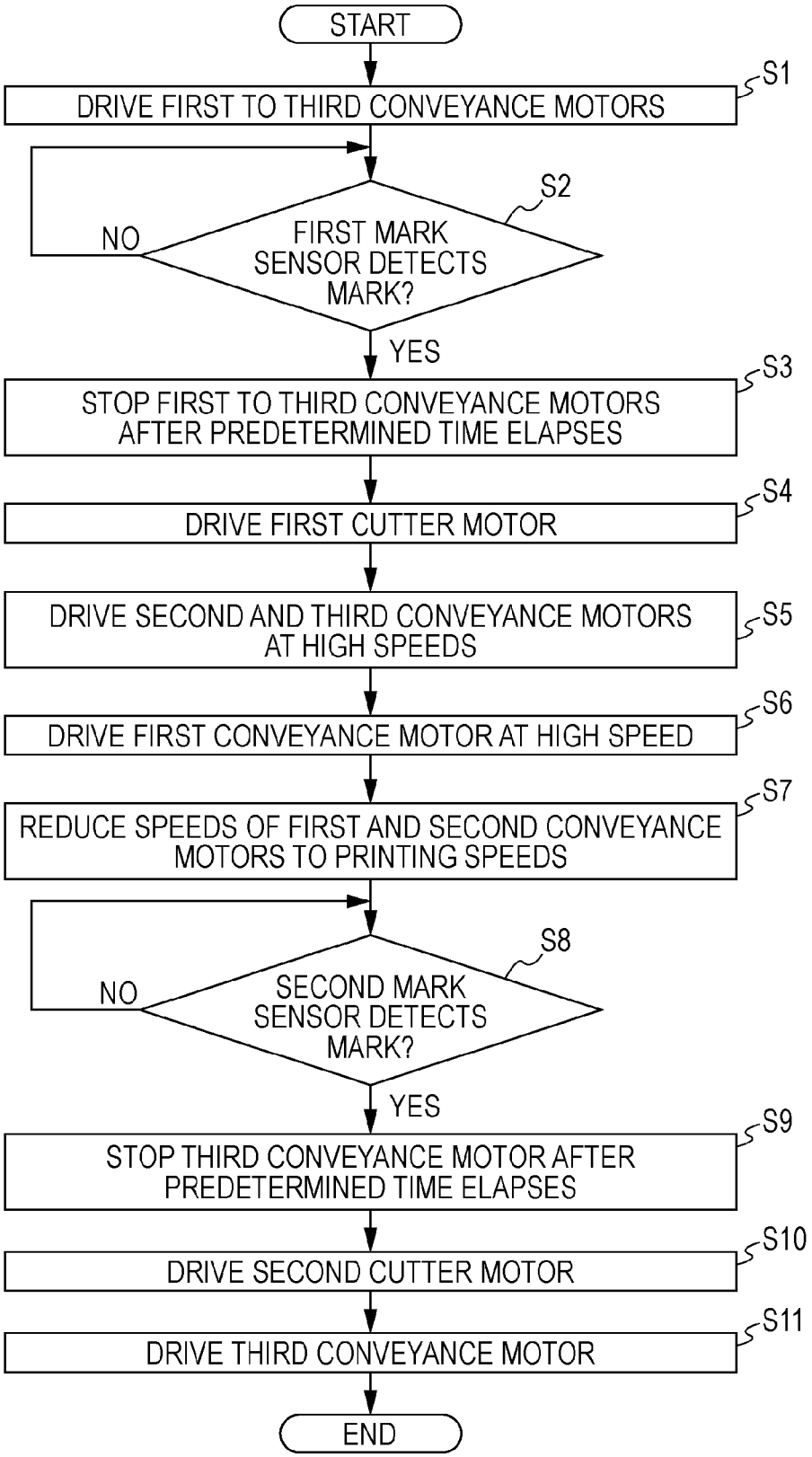
FIG. 4 is a flowchart showing an operation of the image forming apparatus.

Next, the cutting operation according to the first embodiment of the present invention will be specifically described with reference to FIGS. 5A to 5C, 6A and 6B, and a flowchart in FIG. 4. The continuous sheet 7 is conveyed to a cutting device shown in FIG. 5A at the printing conveyance speed Va. In step S1 in FIG. 4, the first conveyance motor 4*a*, the second conveyance motor 5*a*, and the third conveyance motor 6*a* are driven. In the cutting device, the first conveying roller pair 4 and the second conveying roller pair 5 convey the continuous sheet 7 in the direction 15 at the printing conveyance speed Va.

FIG. 5A illustrates a state in which a leading edge of the continuous sheet 7 with an image formed by the image forming unit 1 passes through the first cutter 2 and a trailing edge of the non-image portion 11 reaches a position at which the first cutter 2 can cut the trailing edge. If the first mark sensor 17 detects the cutting mark 9 of the non-image portion 11 in step S2, the first conveyance motor 4*a*, the second conveyance motor 5*a*, and the third conveyance motor 6*a* are stopped after a predetermined time elapses in step S3. The first conveying roller pair 4 and the second conveying roller pair 5 thus convey the continuous sheet 7 by a predetermined distance (in the predetermined time), and then stop the continuous sheet 7 when the trailing edge of the non-image portion 11 reaches a cutting position 2*c* at which the first cutter 2 cuts the trailing edge. FIG. 5A illustrates a state in which the first conveying roller pair 4 and the second conveying roller pair 5 pinch the continuous sheet 7. The continuous sheet 7 may be occasionally pinched only by the first conveying roller pair 4, or by all the first to third conveying roller pairs 4 to 6 depending on the length in the conveying direction of the image portion 10.

Figure 5B:
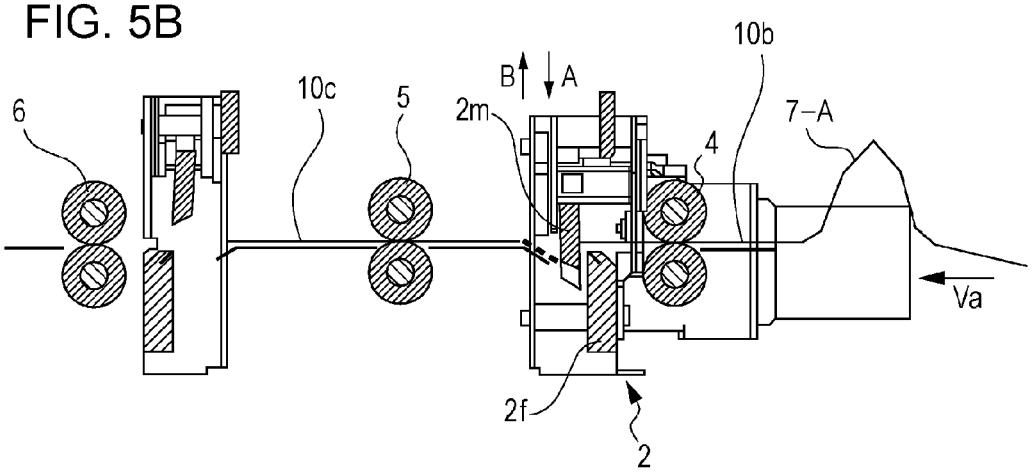

In step S4, the first cutter motor 2*a* is driven to move the movable blade 2*m* of the first cutter 2 in the direction indicated by arrow A in FIG. 5B. The trailing edge in the conveyance direction of the non-image portion 11 (downstream end in the conveyance direction of a second image 10*b*) of the continuous sheet 7 is cut at the cutting position 2*c*. FIG. 5B illustrates a state in which the cutting by the first cutter 2 is ended. When the cutting is ended, the movable blade 2*m* moves in the direction indicated by arrow B. Hence, a gap is provided between the movable blade 2*m* and the fixed blade 2*f* so that the continuous sheet 7 is conveyed through the gap. During this period, the first to third conveying roller pairs 4 to 6 are stopped. While the first to third conveying roller pairs 4 to 6 are stopped, the image forming unit 1 continuously performs a continuous printing operation. Thus, a sag or bulge (loop) 7-A of the continuous sheet 7 is generated at a position located upstream the first conveying roller pair 4 in the conveyance direction as shown in FIG. 5B.

Even if the sag 7-A is generated, the arrangement of this embodiment is provided to prevent an image from being degraded due to cracking of the printed surface or due to a scratch because a guide (not shown) for the continuous sheet 7 slides on the printed surface by the sag 7-A.

Figure 5C:
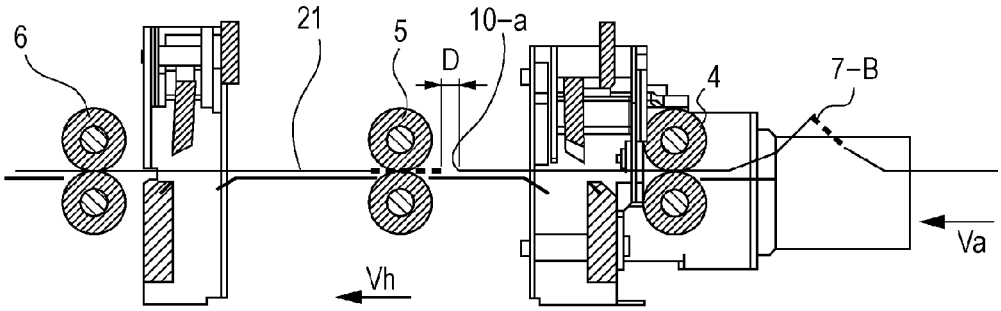

FIG. 5C illustrates a state in which the sag 7-A of the continuous sheet 7 is being reduced. When the gap is provided between the movable blade 2*m* and the fixed blade 2*f* after the cutting operation is ended, the second conveyance motor 5*a* and the third conveyance motor 6*a* are driven at high speeds in step S5. The second and third conveying roller pairs 5 and 6 start rotating, and convey a cut sheet 21, which has been cut from the continuous sheet 7, at a high conveyance speed Vh that is higher than the printing conveyance speed Va. Thus, a gap D is generated between the cut sheet 21 and the continuous sheet 7. Then, the first conveyance motor 4*a* is driven at a high speed, starts rotating, and conveys the continuous sheet 7 at the high conveyance speed Vh in step S6.

The first to third conveying roller pairs 4 to 6 convey the continuous sheet 7 at the high conveyance speed Vh that is higher than the printing conveyance speed Va of the image forming unit 1. A sag length (loop length) of the sag 7-A of the continuous sheet 7 is reduced. That is, the sag 7-A becomes a sag (loop) 7-B. If the gap D is not generated between the cut sheet 21 and the continuous sheet 7, the continuous sheet 7 may contact the cut sheet 21 before or after the cutting. The conveyance of the continuous sheet 7 is interrupted, and the continuous sheet 7 is obliquely conveyed. Thus, cutting accuracy may be degraded, and a scratch or the like may be generated due to sliding on the printed surface. As the result, an image may be degraded.

Figure 6A:
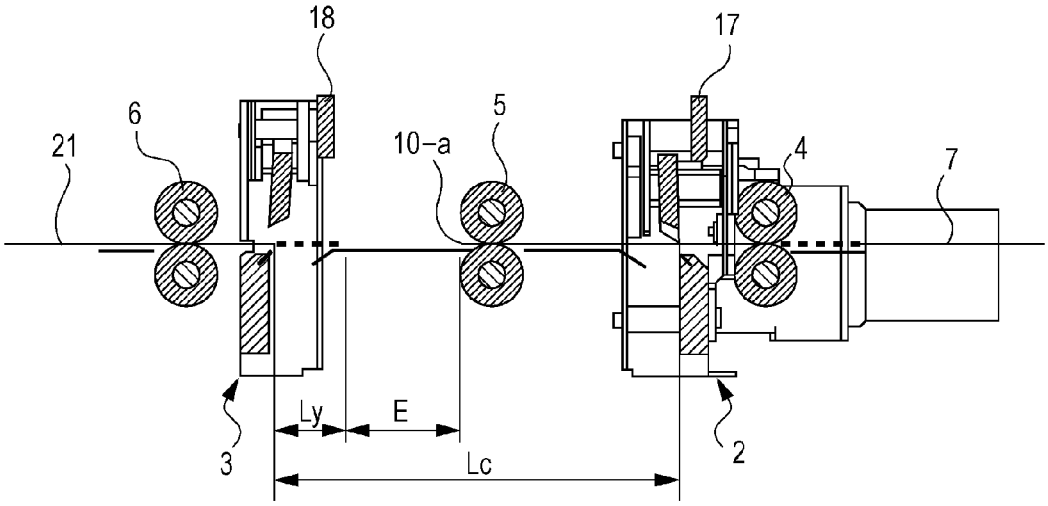
FIGS. 6A and 6B are explanatory views showing the operation of the cutting device.

If the sag 7-B of the continuous sheet 7 is eliminated as shown in FIG. 6A, in step S7, the speeds of the first conveyance motor 4*a* and the second conveyance motor 5*a* are reduced such that the conveyance speed of the continuous sheet 7 becomes the printing conveyance speed Va. At this time, the cut sheet 21 is continuously conveyed at the high conveyance speed Vh.

In this embodiment, a cutting time required for cutting a sheet by the first and second cutters 2 and 3 is Tc (sec). The cutting time Tc is a time from when the gap is present between the movable blade 2*m* and the fixed blade 2*f* as shown in FIG. 5A until the movable blade 2*m* has (i) moved in the direction indicated by arrow A, (ii) cut the sheet, (iii) moved in the direction indicated by arrow B, and (iv) returned to the original position. The shorter the cutting time Tc (sec) is, the smaller the sag length of the continuous sheet 7 formed during the cutting. In this embodiment, the cutting time Tc is a fraction of a second. To further reduce the cutting time, the output of a driving unit, for example, a DC motor, for the movable blade may be increased. However, a current value, an inductance of a wire, and the size of the motor have to be increased to increase the output torque. If the current is increased with the unchanged inductance, the sectional area of the wire has to be increased. As the result, the size of the motor is increased. This may increase the cost, and the size of the entire apparatus. If the size of the motor is increased, acceleration performance of the motor is increased. However, rotational inertia of the motor is also increased, and hence a time may be required to stop the motor. Also, if the inductance (the number of turns) of the wire is increased, electric time constant is increased, and hence a speed at startup may be low.

During the cutting for the continuous sheet 7, the first conveying roller pair 4 is stopped, and the image forming unit 1 provided upstream the first conveying roller pair 4 conveys the continuous sheet 7 at the printing conveyance speed Va. A maximum sag length of the continuous sheet 7 is as follows:

$$\text{(Maximum sag length of continuous sheet 7)} = Tc \times Va \quad (1).$$

After the cutting, the continuous sheet 7 is conveyed at the printing conveyance speed Va in the image forming unit 1, and conveyed by the first conveying roller pair 4 at the high conveyance speed Vh. A reduced length per unit time of the sag length of the continuous sheet 7 is as follows:

$$\text{(Reduced length per unit time of sag length of continuous sheet 7)} = Vh - Va \quad (2).$$

Here, a time required for elimination of the maximum sag length is theoretically obtained as follows:

(Time required for elimination of maximum sag length of continuous sheet 7)=(maximum sag length of continuous sheet 7)/(reduced length per unit time of sag length of continuous sheet 7).

By using Expressions 1 and 2, the above expression is rewritten as follows:

$$(\text{Time required for elimination of maximum sag length of continuous sheet 7})=(Tc\times Va)/(Vh-Va) \quad (3).$$

Further, using Expression 3, a conveyed distance of a leading edge 10-*a* of the continuous sheet 7 after the leading edge 10-*a* is cut by the first cutter 2 before the maximum sag length of the continuous sheet 7 is eliminated is as follows:

$$(\text{Conveyed distance after cutting})=(\text{high conveyance speed})\times(\text{time required for elimination of maximum sag length of continuous sheet 7}).$$

By using Expression 3, the above expression is rewritten as follows:

$$(\text{Conveyed distance after cutting})=Vh\times(Tc\times Va)/(Vh-Va) \quad (4).$$

In FIG. 6A, Ly is a length of the non-image portion 11 of the continuous sheet 7. Lc is a distance between the cutting position 2*c* by the first cutter 2 and a cutting position 3*c* by the second cutter 3.

Thus, a distance by which the leading edge of the non-image portion 11 of the cut sheet 21 cut from the continuous sheet 7 by the first cutter 2 is conveyed until the leading edge is cut by the second cutter 3 as shown in FIG. 6A is obtained as follows:

$$Lc-Ly.$$

A relationship among Vh (mm/sec), Tc (sec), Va (mm/sec), Ly (mm), and Lc (mm) for the first and second cutters 2 and 3 according to the embodiment of the present invention is as follows:

$$(Lc-Ly)\geq[Vh\times(Tc\times Va)/(Vh-Va)] \quad (5).$$

Since the relationship by Expression 5 is established, the sag of the continuous sheet 7 generated by the first cutter 2 can be eliminated by a single cycle of the cutting operation. Hence, even when a plurality of cycles of the cutting operation are performed, the maximum sag length of the continuous sheet 7 is not increased through accumulation.

If the second mark sensor 18 detects the edge of the cutting mark 9 of the cut sheet 21, which has been cut and separated from the continuous sheet 7, in step S8, the third conveyance motor 6*a* is stopped after a predetermined time elapses in step S9. The third conveying roller 6 conveys the cut sheet 21 by a predetermined distance until the leading edge of the non-image portion 11 reaches the cutting position 3*c* by the second cutter 3. In step S10, the second cutter motor 3*a* is driven, so that an upstream end in the conveyance direction of a first image 10*c* is cut by the second cutter 3 and hence the non-image portion 11 located upstream the trailing edge of the cut sheet 21 is cut and separated at the cutting position 3*c*. As described above, one the first and second cutters 2 and 3 cuts the upstream end in the conveyance direction of the image of the continuous sheet 7, and the other cuts the downstream end in the conveyance direction of the same image. Accordingly, the printout can be cut and separated from the continuous sheet 7.

If the leading edge 10-*a* of the continuous sheet 7 approaches and reaches the non-image portion 11 during the cutting, the cut sheet 21 pinched by the third conveying roller pair 6 slips relative to the third conveying roller pair 6. The accuracy of the cutting position is reduced. To prevent the leading edge 10-*a* of the continuous sheet 7 from reaching the non-image portion 11 during the cutting until the non-image portion 11 of the cut sheet 21 is cut by the second cutter 3, the following control is performed.

The movable blade position sensor (not shown) detects the end of the reciprocal operation by the movable blade 2*m* of the first cutter 2 shown in FIG. 5B.

First, a time required for the leading edge of the non-image portion 11 of the cut sheet 21, cut and separated from the continuous sheet 7 by the first cutter 2, to be conveyed to the cutting position 3*c* by the second cutter 3 at the high conveyance speed Vh after the trailing edge of the non-image portion 11 is cut, is as follows:

$$(Lc-Ly)/Vh.$$

Next, since Tc is the time required for the second cutter 3 to perform the cutting operation, the required time from when the first cutter 2 ends (completes) cutting and separating the cut sheet 21 to when the second cutter 3 ends (completes) cutting the non-image portion 11 of the cut sheet 21, is as follows:

$$(Lc-Ly)/Vh+Tc(\text{sec}) \quad (6).$$

Then, a time required for the cut sheet 21 to be cut and separated by the first cutter 2, and for the leading edge of the image portion 10 of the continuous sheet 7, remaining at the upstream side, to be conveyed at the high conveyance speed Vh is obtained by Expression 3 as described above. Thus, a distance of the conveyance at the high conveyance speed Vh is calculated as follows:

$$Vh\times(Tc\times Va)/(Vh-Va)(\text{sec}) \quad (7).$$

A distance of the conveyance at the reduced speed, that is the printing conveyance speed Va after the sag is eliminated, is subtracted from the distance (Lc−Ly) of the conveyance until the continuous sheet 7 reaches the trailing edge of the cut sheet 21 as follows:

$$(Lc-Ly)-Vh\times(Tc\times Va)/(Vh-Va)(\text{mm}).$$

Hence, a time for the conveyance at the printing conveyance speed Va after the sag of the continuous sheet 7 is eliminated, because of the conveyance at the high conveyance speed Vh, is as follows:

$$[(Lc-Ly)-Vh\times(Tc\times Va)/(Vh-Va)]/Va \quad (8).$$

Using the above expressions, continuous sheet reach time=(7)+(8) is expressed as follows:

$$(Tc\times Va)/(Vh-Va)+[(Lc-Ly)-Vh\times(Tc\times Va)/(Vh-Va)]/Va \quad (9).$$

In this embodiment of the present invention, the respective constants are determined to satisfy a relationship as follows:

Cut sheet non-image portion cut end time (6) continuous sheet reach time (8).

In particular, the respective constants are determined by a condition as follows:

$$(Lc-Ly)/Vh+Tc\leq(Tc\times Va)/(Vh-Va)+[(Lc-Ly)-Vh\times(Tc\times Va)/(Vh-Va)]/Va \quad (10).$$

Figure 6B:
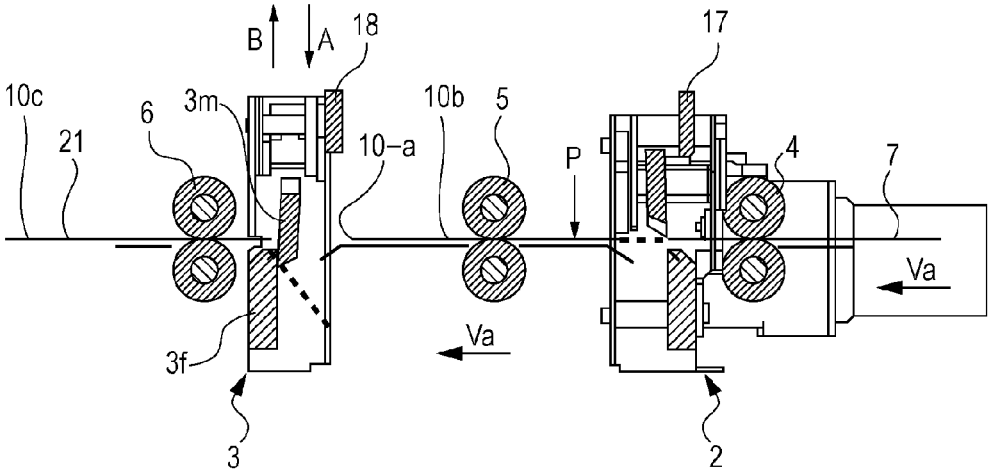

FIG. 6B illustrates a state in which the non-image portion 11 is cut and separated from the cut sheet 21 by the second cutter 3 before the leading edge 10-*a* of the continuous sheet 7 reaches the trailing edge of the non-image portion 11 of the cut sheet 21. Similarly to the first cutter 2, the second cutter 3 ends the cutting operation such that the movable blade 3*m* at the upstream side in the conveyance direction reciprocates in the directions indicated by arrows A and B in FIG. 6B.

In step S11, the third conveyance motor 6*a* is driven, so that the cut sheet 21 is conveyed to the downstream side. The conveyance speed at this time may be the high speed or the low speed depending on the state at the downstream side. Referring to FIG. 6A, when the non-image portion 11 of the cut sheet 21 is cut, the next non-image portion 11 approaches the first cutter 2. The operation for cutting the next non-image portion 11 is repeatedly performed from step S1.

The printed surface of the continuous sheet 7 is at the side P. Thus, the movable blade 3*m* (first blade) contacts the non-image portion 11 on the printed surface and the fixed blade 3*f* (second blade) contacts the back surface of the printed surface. Even if a dye component or a pigment component in ink on the printed surface adheres to the movable blade 3*m*, the movable blade 3*m* contacts the non-image portion 11 of the continuous sheet 7 during the next cutting. The image quality of an image surface is not degraded due to re-transferring from the movable blade 3*m* by such adhesion.

In this embodiment, the different first and second cutters perform the separation between the upstream end of the image portion 10 and the non-image portion 11 and the separation between the downstream end of the image portion 10 and the non-image portion 11. Also, the sheet is conveyed at the higher speed Vh between the cutters than the speed in the image forming unit 1. With this configuration, even if a sag is generated for the continuous sheet 7, the sag can be reduced immediately.

If a single cutter performs the cutting for the continuous sheet in which the image portion 10 and the non-image portion 11 are alternately arranged, the continuous sheet 7 has to be stopped at short intervals at the upstream and downstream positions of the non-image portion 11, which is a relatively short portion. Hence, the sag may be increased. The increase of the sag may cause a coating on a surface of the continuous sheet 7 to become cracked or scratched. In contrast, with this embodiment, the loop is not increased, and can be eliminated.

In particular, if a photo printing apparatus is used, the continuous sheet 7 has a thickness of 100 μm or larger and printing at a high speed with a high quality is desired. In this case, the continuous sheet 7 has to be stopped during cutting. In this embodiment, even if the continuous sheet 7 with the thickness of 100 μm is conveyed at a high speed Vh in the image forming unit, the continuous sheet can be stopped without difficulty.

Also, since the length in the conveyance direction of the non-image portion 11 can be changed depending on an image, the printed state detection pattern for measuring the printed state of an image can be printed at irregular timing. Thus, the quality of a printout can be increased.

The length of the non-image portion 11 can be optimized in accordance with a length of an image and a use amount of ink for the image. An optimal image can be obtained while an ink consumption in the non-image portion is minimized. Thus, the running cost can be decreased.

The length of the non-image portion can be changed in accordance with an image size and a process factor such as the presence of a duty for an image. Thus, the length of the non-image portion 11, which is not essential, can be optimized for every image. As the result, the amount of wasted continuous sheet 7 and the amount of wasted ink can be minimized in accordance with the length of the non-image portion 11. The running cost for printing can be decreased.

In addition, the blade of the first or second cutter 2 or 3 does not contact the image portion on the printed surface. Even if the apparatus is used for a long period, fine (good quality) images can be obtained.

Second Embodiment

An image forming apparatus according to a second embodiment of the present invention will be described below with reference to the attached drawings.

Figure 7:
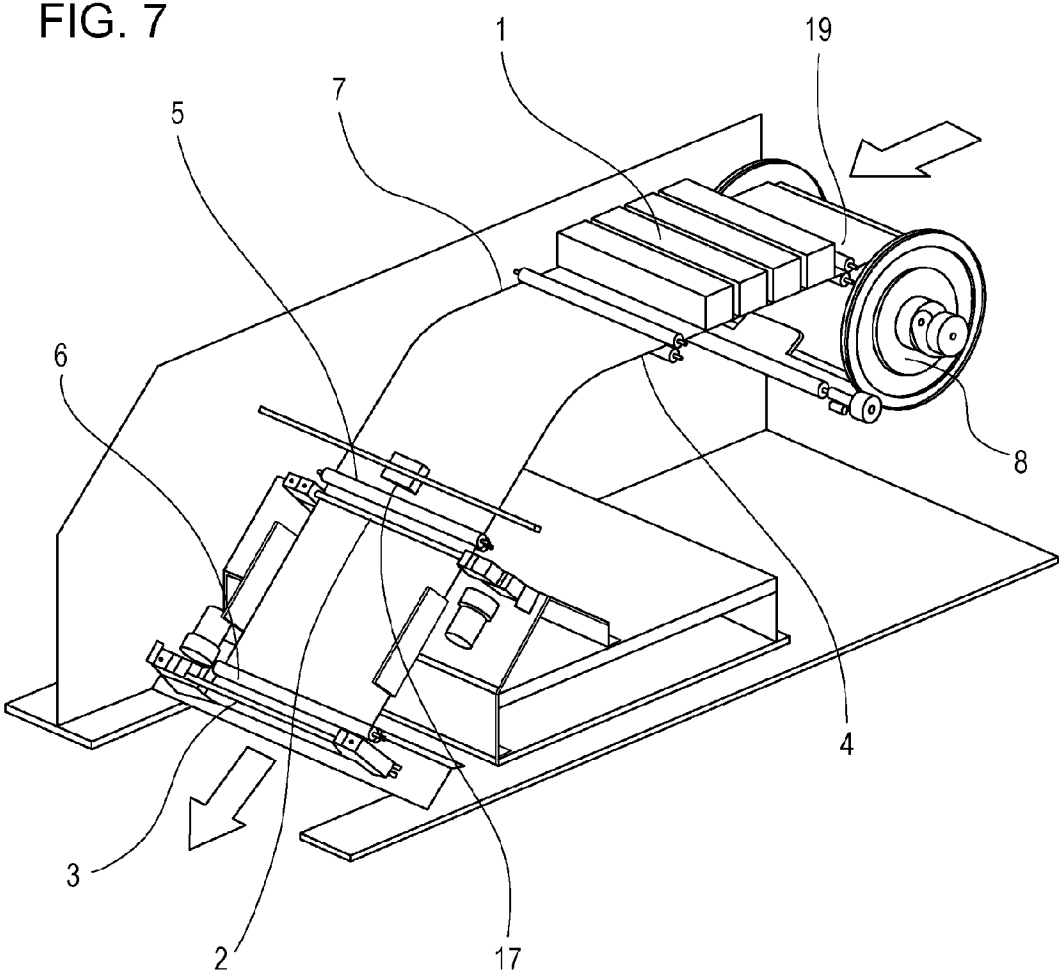
FIG. 7 is a perspective view showing the overview of an image forming apparatus including an image forming unit according to a second embodiment of the present invention.

Referring to FIG. 7, the image forming apparatus includes a first main conveying roller pair 19 that conveys in a conveyance direction a continuous sheet 7 fed from a continuous sheet feeding unit 8. An image forming unit 1 includes a plurality of recording heads that print an image on the continuous sheet 7 being conveyed in the conveyance direction. The image forming unit 1 forms images while forming a blank portion (non-image portion) between the images. A first conveying roller pair 4, a second conveying roller pair 5, and a third conveying roller pair 6 which convey the continuous sheet 7; a first mark sensor 17, a first cutter 2, and a second cutter 3 are provided downstream of the image forming unit 1.

In the second embodiment, the position of the first cutter 2 and the position at which a sag of the continuous sheet 7 is formed are different from those of the first embodiment. However, the control block diagram in FIG. 3 can be referenced. Hence, the second embodiment will be described also with reference to FIG. 3.

Figure 8:
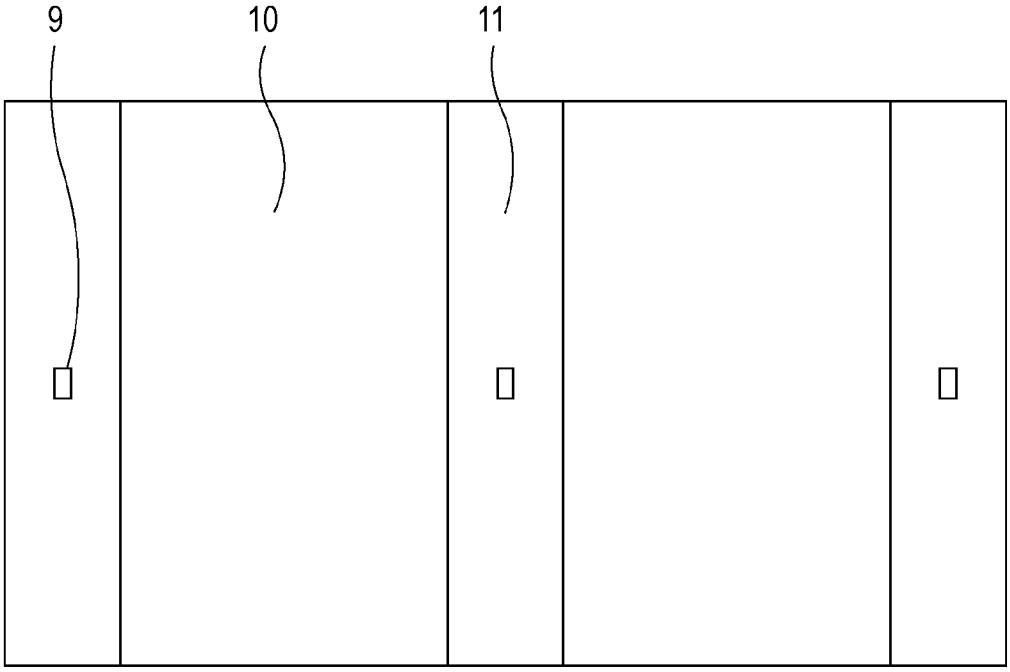
FIG. 8 illustrates a printed state of an image, a non-image, and a cutting mark, which are printed by the image forming unit according to the second embodiment.

The image forming unit 1 alternately forms an image portion 10 and a non-image portion 11 on the continuous sheet 7 as shown in FIG. 8. Also, the image forming unit 1 prints a cutting mark 9 on the non-image portion 11.

Figure 9:
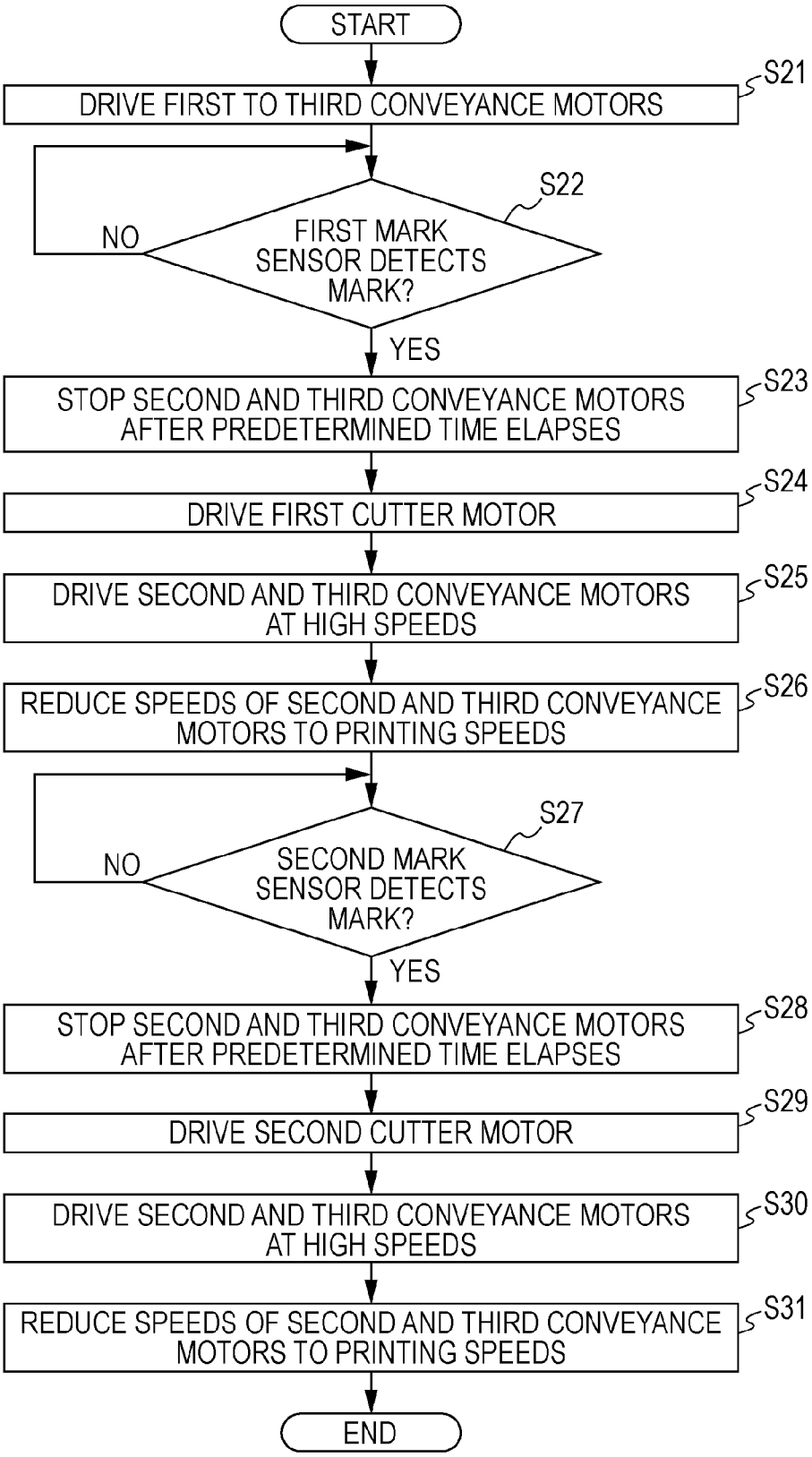
FIG. 9 is a flowchart showing an operation of the image forming apparatus according to the second embodiment.
Figure 10A:
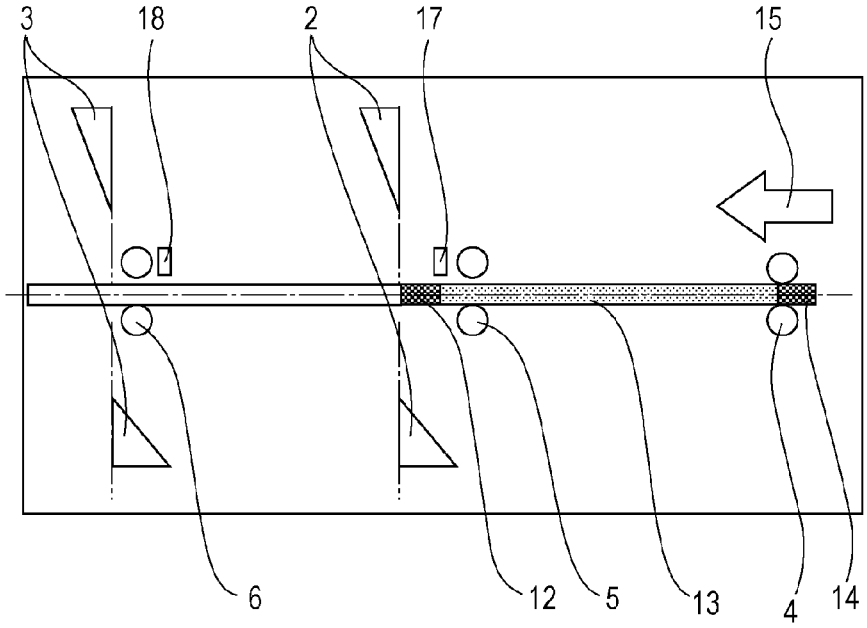
FIGS. 10A and 10B are explanatory views each showing an operation of a cutting device according to the second embodiment.

An operation of the image forming apparatus will be described below with reference to a flowchart in FIG. 9, as well as FIGS. 10A and 10B, 11A and 11B, and 12A and 12B. In step S21, a first conveyance motor 4*a*, a second conveyance motor 5*a*, and a third conveyance motor 6*a* are driven, so that the first conveying roller pair 4, the second conveying roller pair 5, and the third conveying roller pair 6 convey the continuous sheet 7 in a direction 15. If the first mark sensor 17 detects the cutting mark 9 in step S22, the second conveyance motor 5*a* and the third conveyance motor 6*a* are stopped after a predetermined time elapses in step S23. Consequently the second conveying roller pair 5 and the third conveying roller pair 6 feed the continuous sheet 7 by a predetermined length, and then are stopped. Referring to FIG. 10A, the continuous sheet 7 includes an image portion 13, a first non-image portion 12, and a second non-image portion 14. Referring to FIG. 10A, the continuous sheet 7 is stopped at a position at which a downstream end of the first non-image portion 12 can be cut by the first cutter 2.

At this time, the second conveying roller pair 5 and the third conveying roller pair 6 stop the conveyance, in order to improve the perpendicularity of the cut surface of the sheet. With regard to a conveyance error between the second conveying roller pair 5 and the third conveying roller pair 6, another mark sensor (second mark sensor 18, not shown) may be provided upstream the second cutter 3 to increase conveyance accuracy.

In step S24, the first cutter motor 2*a* is driven, so that the first cutter 2 cuts the downstream end of the first non-image portion 12.

Figure 10B:
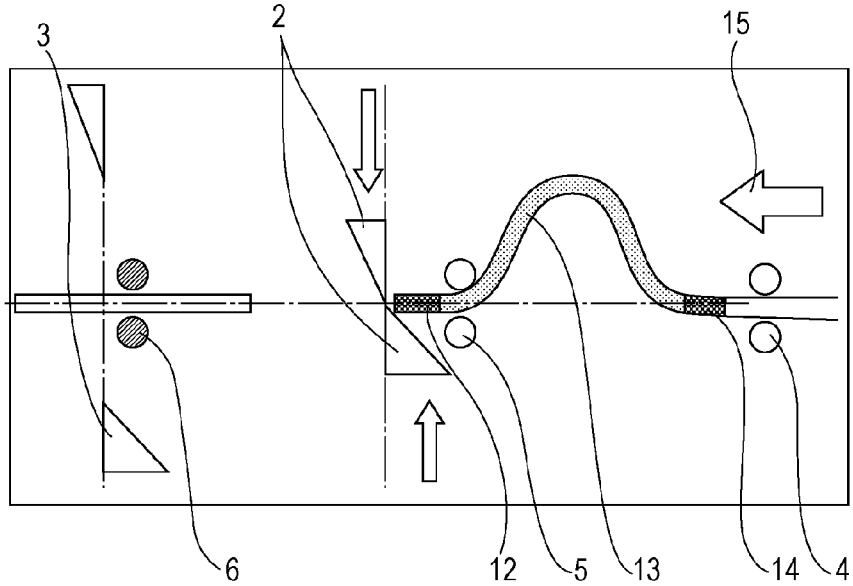

While the second conveying roller pair 5 and the third conveying roller pair 6 are stopped, the image forming unit 1 continuously performs printing, and the first conveying roller pair 4 continuously performs conveyance. Then, a sag (loop of sheet) is formed between the first conveying roller pair 4 and the second conveying roller pair 5 as shown in FIG. 10B. A sag length (loop length) is equivalent to a conveyed distance by the first conveying roller pair 4 while the second conveying roller pair 5 is stopped during the cutting. In particular, the sag length is as follows:

$$(\text{Sag length}) = Tc \times Va \quad (11).$$

When the cutting is ended, in step S25, the second conveyance motor 5*a* and the third conveyance motor 6*a* are driven at high speeds to eliminate the sag. The generated sag is eliminated when the second conveying roller pair 5 is rotated at a high speed after the cutting is ended. A conveyance speed Vh of the second conveying roller pair 5 at this time has to be at least a speed that allows the sag to be eliminated before the second non-image portion 14 reaches the first cutter 2. A time required for elimination of the sag is as follows:

$$(\text{Sag elimination time})=(Tc\times Va)/(Vh-Va) \quad (12).$$

A distance by which the first conveying roller pair 4 conveys the second non-image portion 14 during the sag elimination time is as follows:

$$Va(Tc\times Va)/(Vh-Va) \quad (13).$$

In the state shown in FIG. 10A, the downstream end of the second non-image portion 14 is located upstream a cutting position by the first cutter 2 by a distance as follows:

$$Ly+(\text{cut length}) \quad (14).$$

Hence, a condition is as follows:

$$Ly+(\text{cut length})>Va(Tc\times Va)/(Vh-Va) \quad (15).$$

Expression 15 is the condition that allows the sag to be eliminated before the second non-image portion 14 reaches the first cutter 2.

Also, after the cutting, the third conveying roller pair 6 conveys the sheet at a rotation speed that is equal to or higher than a speed of the second conveying roller pair 5 that is eliminating the sag.

When the sag is eliminated, the speeds of the second conveying roller pair 5 and the third conveying roller pair 6 are reduced to a printing conveyance speed in step S26.

Figure 11A:
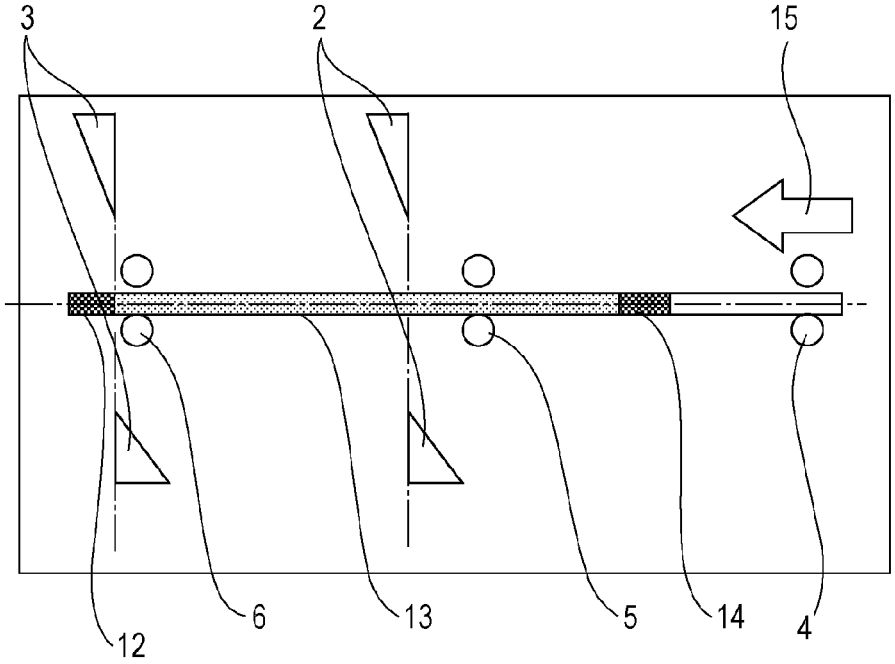
FIGS. 11A and 11B are explanatory views each showing the operation of the cutting device according to the second embodiment.

If the second mark sensor 18 detects the cutting mark 9 in step S27, the second conveyance motor 5*a* and the third conveyance motor 6*a* are stopped after a predetermined time elapses in step S28. The continuous sheet 7 is conveyed to and stopped at a position as shown in FIG. 11A, the position at which the second cutter 3 can cut and separate the first non-image portion 12 from the image portion 13. In step S29, the second cutter motor 3*a* is driven, so that the first non-image portion 12 is cut and separated from the image portion 13.

Figure 11B:
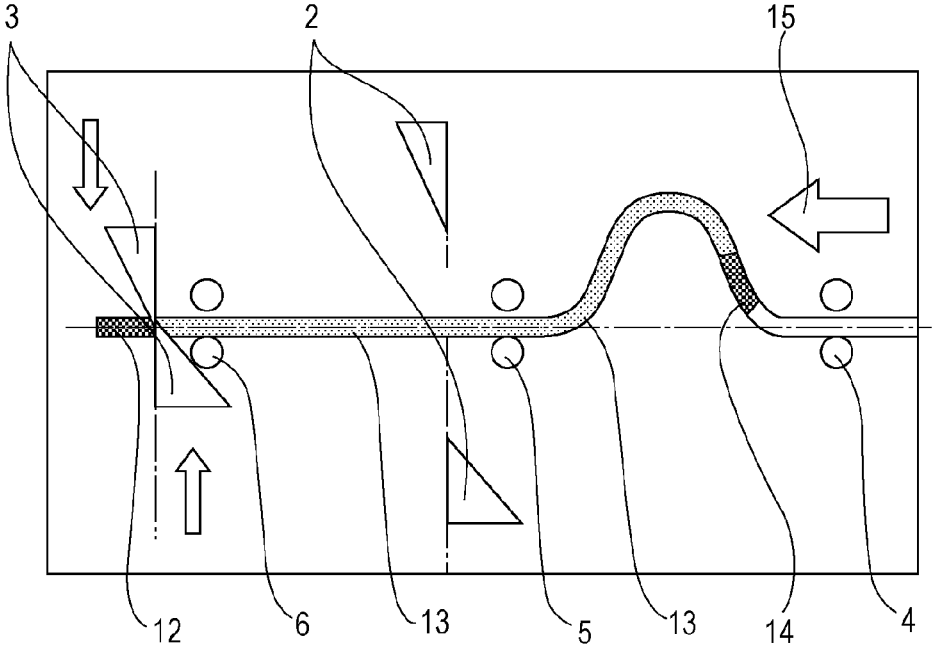

While the second conveying roller pair 5 and the third conveying roller pair 6 are stopped, the image forming unit 1 continuously performs the printing, and the first conveying roller pair 4 continuously perform the conveyance. FIG. 11B illustrates a sag (loop) generated during the above situation. The sag is generated at a position located upstream the second conveying roller pair 5 in the conveyance direction. A sag length (loop length) is equivalent to a conveyed distance by the first conveying roller pair 4 while the second conveying roller pair 5 is stopped during the cutting. In particular, the sag length is as follows:

$$(\text{Sag length})=Tc\times Va \quad (16).$$

The generated sag is eliminated when the second conveying roller pair 5 and the third conveying roller pair 6 are rotated at high speeds in step S30 after the cutting is ended. A conveyance speed Vh of the second conveying roller pair 5 at this time has to be at least a speed that allows the sag to be eliminated before the second non-image portion 14 reaches the first cutter 2. That is, a speed that allows the sag to be reduced is as follows:

$$(\text{Sag reducing speed})=Vh-Va \quad (17).$$

A time required for elimination of the sag is as follows:

$$(\text{Sag elimination time})=(Tc\times Va)/(Vh-Va) \quad (18).$$

A distance by which the first conveying roller pair 4 conveys the second non-image portion 14 during the sag elimination time is as follows:

$$Va(Tc\times Va)/(Vh-Va) \quad (19).$$

A distance, by which the first conveying roller pair 4 conveys the second non-image portion 14 from the state shown in FIG. 11A to the formation of the sag is as follows:

$$Tc\times Va \quad (20).$$

A distance by which the first conveying roller pair 4 conveys the second non-image portion 14 until the elimination of the sag is as follows:

$$Va(Tc\times Va)/(Vh-Va) \quad (21).$$

In the state shown in FIG. 11A, the downstream end of the second non-image portion 14 is provided upstream the cutting position by the first cutter 2 by a distance as follows:

$$(\text{Cut length})-Lc \quad (22).$$

Hence, a relationship is as follows:

$$(\text{Cut length})-Lc>Tc\times Va+Va(Tc\times Va)/(Vh-Va) \quad (23).$$

Expression 23 is a condition that the second non-image portion 14 does not reach the cutting position at the first cutter 2 even if the first non-image portion 12 is cut from the state shown in FIG. 11A and the sag generated during the cutting is eliminated.

This is provided as a conditional expression that establishes the second embodiment. Also, after the cutting, the third conveying roller pair 6 conveys the sheet at a rotation speed that is equal to or higher than a speed of the second conveying roller pair 5 that is eliminating the sag. When the sag is eliminated, the speeds of the second conveying roller pair 5 and the third conveying roller pair 6 are reduced to a printing conveyance speed in step S31.

Figure 12A:
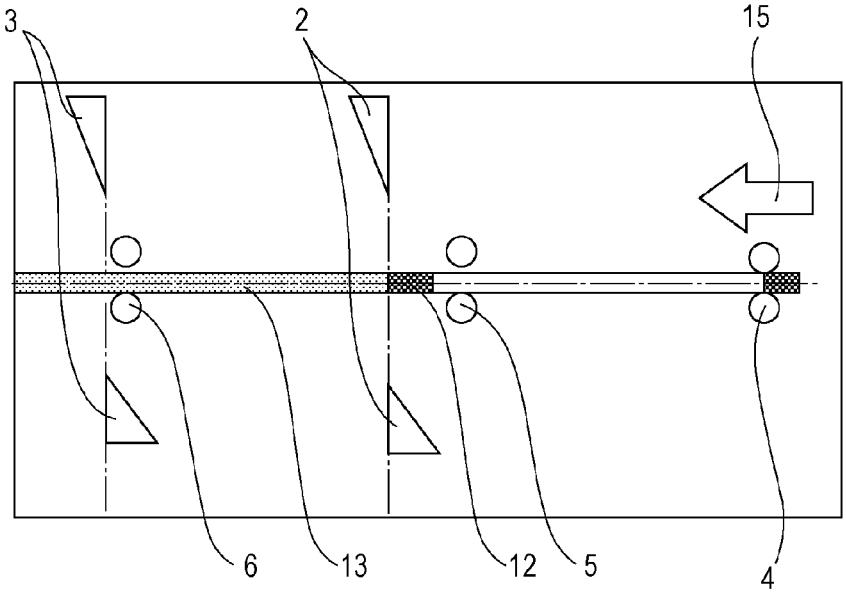
FIGS. 12A and 12B are explanatory views each showing the operation of the cutting device according to the second embodiment.

Then, the operation goes back to step S21, and the first mark sensor 17 detects the mark on the second non-image portion 14 in step S22. Referring to FIG. 12A, in step S23, the continuous sheet 7 is stopped at a position at which a downstream end of the second non-image portion 14 can be cut by the first cutter 2. Even during this stoppage, the image forming unit 1 continuously performs the printing, and the first conveying roller pair 4 continuously performs the conveyance.

Figure 12B:
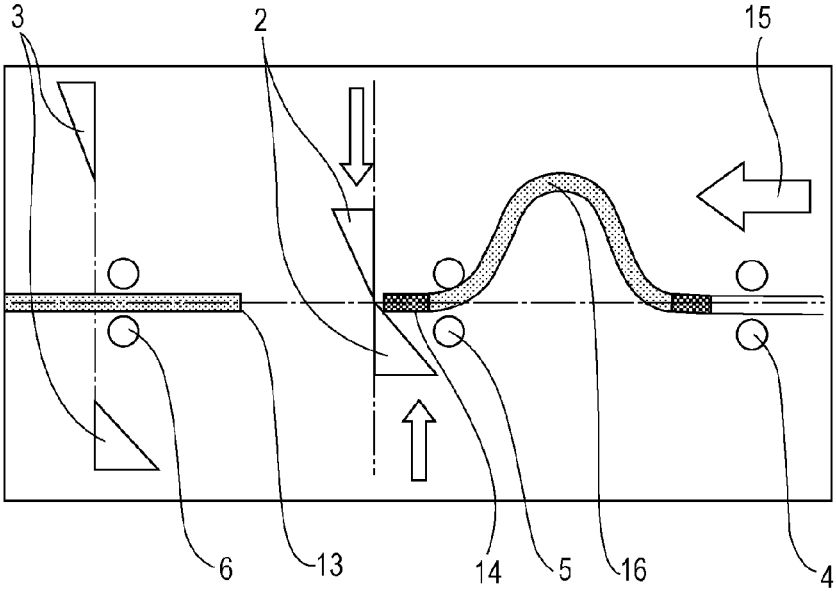

FIG. 12B illustrates a state in which the first cutter 2 cuts the second non-image portion 14. By cutting a leading edge of the second non-image portion 14, the cutting for the image portion 13 is ended, and hence only the image portion can be cut and obtained. FIG. 12B illustrates the same state as the state shown in FIG. 10B. The operation continues to the cutting for the next image portion 16.

A conditional expression by which this embodiment is established is as follows:

$$(Tc\times Va)/Vh<(Ly+\text{cut length})/Va \quad (24), \text{ and}$$

$$\text{Cut length}\geq Lc+(Va2\times Tc)/(Vh-Va) \quad (25),$$

where Va is a conveyance speed by the first conveying roller pair 4, Tc is a stop time of the second conveying roller pair 5 during the cutting, Vh is a high conveyance speed of the second conveying roller pair 5 during the elimination of the sag, Lc is a distance between the cutting position by the first cutter 2 and the cutting position by the second cutter 3, and Ly is a length of the non-image portion. With the cut length in addition to the above values, the inequality is provided. The cut length is substantially equivalent to a length in the conveyance direction of the image portion 13. If a printout without a margin is formed, the cut length becomes smaller than the length of the image portion 13 in the conveyance direction. If a printout with margins is formed, the cut length becomes larger than the length of the image portion 13.

Here, Expression 24 is a condition that is satisfied by a next portion to be cut by the first cutter 2 after the sag generated during the cutting by the second cutter 3 is eliminated. Also, Expression 25 is a condition for the cutting operation by the second cutter 3 after the sag generated by cutting by the first cutter 2 is eliminated.

Third Embodiment

Figure 13:
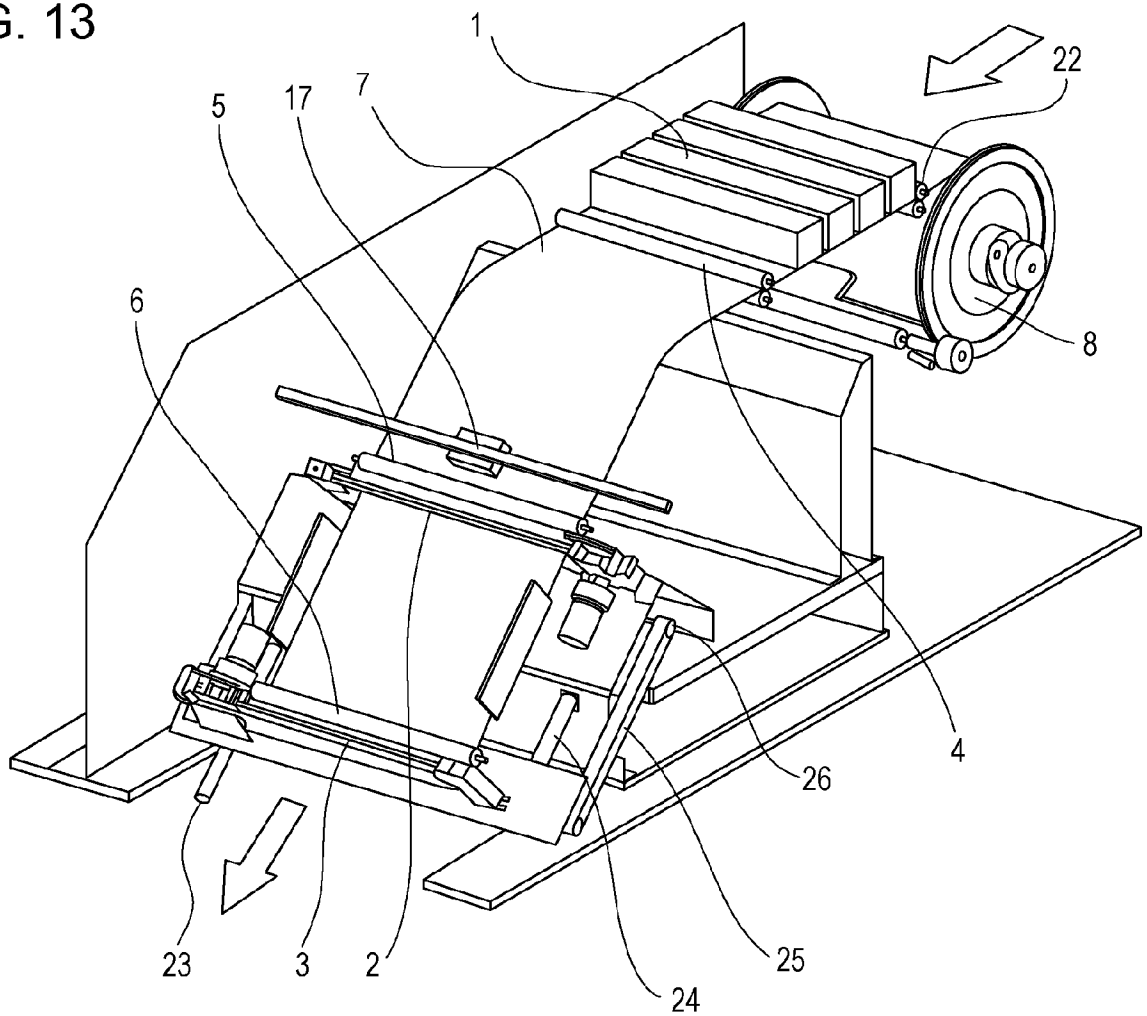
FIG. 13 is a perspective view showing the overview of an image forming apparatus including a image forming unit according to a third embodiment of the present invention.
Figure 15A:
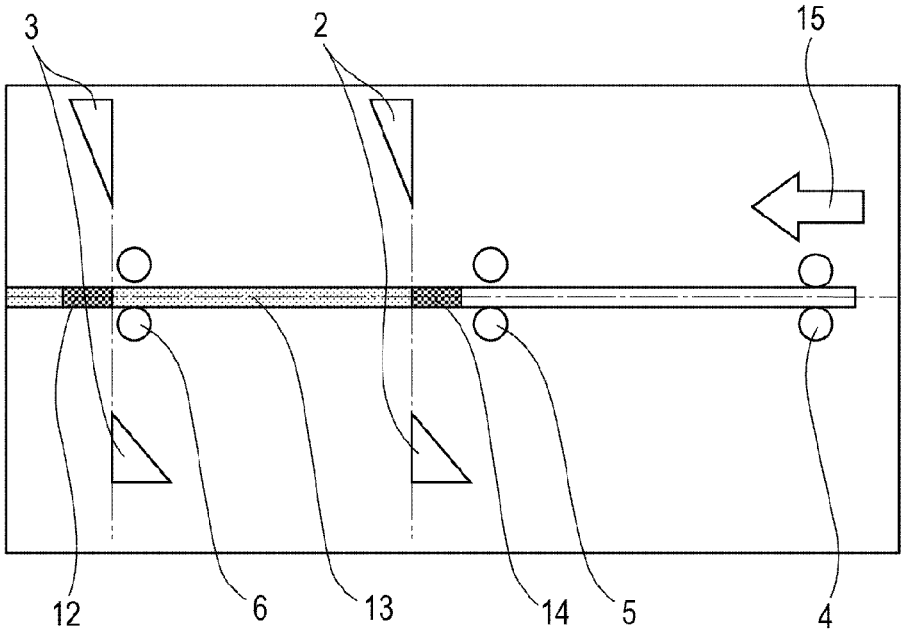
FIGS. 15A and 15B are explanatory views each showing an operation of a cutting device according to the third embodiment.
Figure 15B:
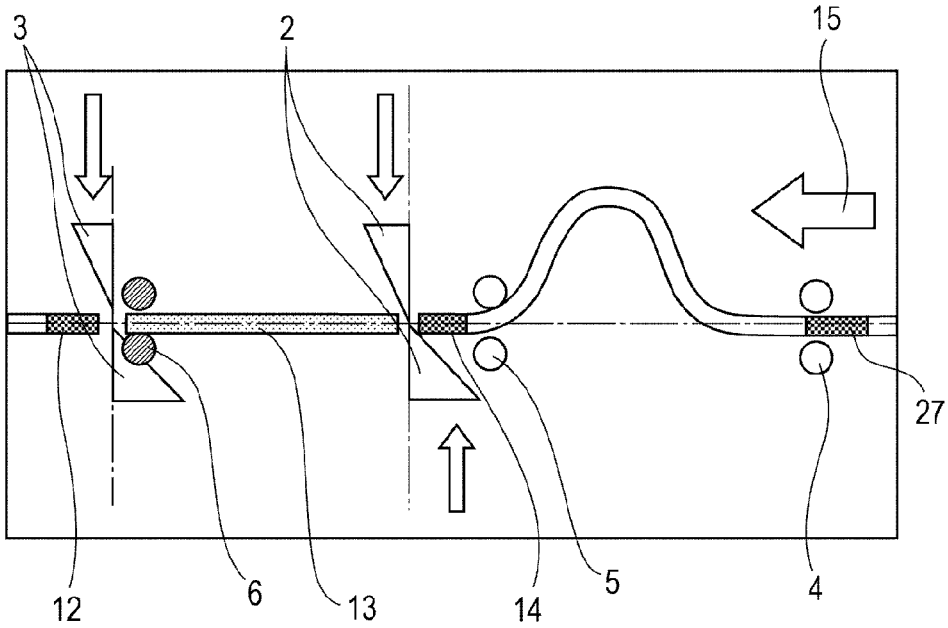

Next, a third embodiment of the present invention will be described. FIG. 13 illustrates a configuration of an image forming apparatus according to the third embodiment. FIGS. 15A and 15B illustrate the details of an operation according to this embodiment.

Referring to FIG. 13, the image forming apparatus includes a main conveying roller pair 22 that conveys in a conveyance direction a continuous sheet 7 fed from a continuous sheet feeding unit 8. An image forming unit 1 continuously prints images on the continuous sheet 7 by the main conveying roller pair 22 while forming a blank portion (non-image portion) between the images. A first conveying roller pair 4, a second conveying roller pair 5, and a third conveying roller pair 6, which convey the continuous sheet 7 from the image forming unit 1 to a cutting device, are provided downstream the image forming unit 1. Also, a mark sensor 17 that detects a cutting mark in the non-image portion, and a first cutter 2 and a second cutter 3 are arranged. The second cutter 3 is movable along guide shafts 23 and 24 arranged in parallel to the conveyance direction. The distance between the first and second cutters 2 and 3 is adjustable in accordance with a desirable cut length. The adjustment is performed by a timing belt 25 and a motor 26. In the following description, it is expected that a cut length is equivalent to a length in the conveyance direction of the image portion 13. However, the cut length becomes shorter than the length in the conveyance direction of the image portion if the end of the image is trimmed, or larger than the length in the conveyance direction of the image portion if the image has a binding margin, depending on a formation mode of a printout.

Figure 14:
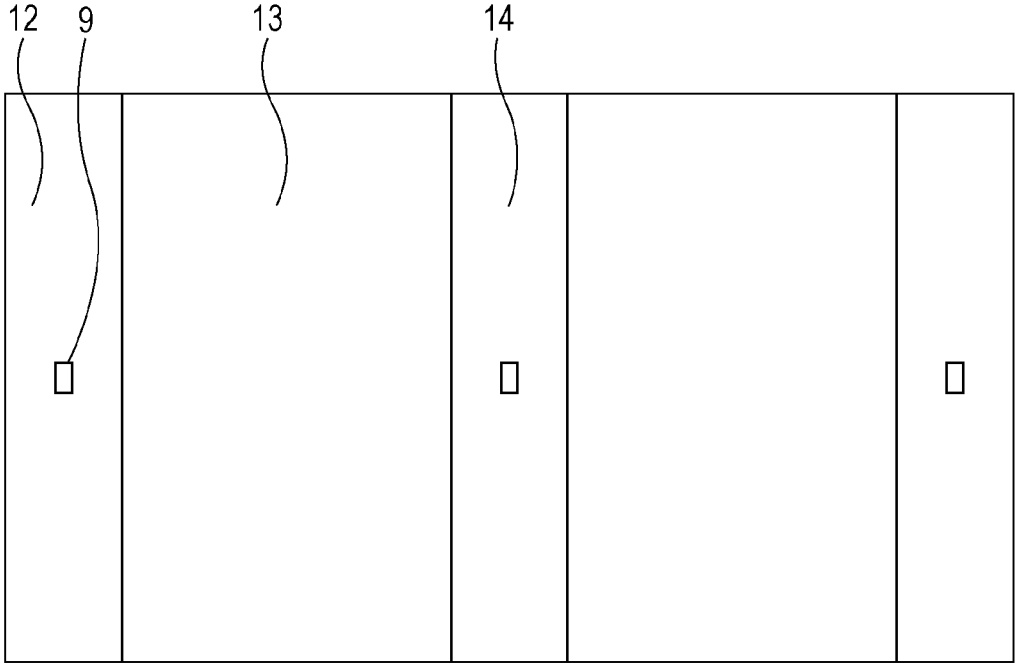
FIG. 14 illustrates a printed state of an image, a non-image, and a cutting mark, which are printed by the image forming unit according to the third embodiment.

Referring to FIG. 14, the image forming unit 1 alternately forms on the continuous sheet 7 the image portion 13 with an image formed in accordance with image information, and first and second non-image portions 12 and 14 without an image. The image forming unit 1 also prints cutting marks 9 in the first and second non-image portions 12 and 14. If the mark sensor 17 detects the cutting mark 9, the continuous sheet 7 is fed by a predetermined length, located at predetermined positions, and cut by the first and second cutters 2 and 3. Thus, the image portion 13 is cut and separated. At this time, the second conveying roller pair 5 and the third conveying roller pair 6 stop the conveyance, in order to improve the perpendicularity of the cut surface of the sheet.

Next, an operation of the third embodiment will be described below with reference to FIGS. 15A and 15B.

In FIG. 15A, the continuous sheet 7 is conveyed in a direction 15. The motor 26 moves the second cutter 3. Accordingly, the distance between the cutting position by the first cutter 2 and the cutting position by the second cutter 3 can be changed. The distance between the cutting position by the first cutter 2 and the cutting position by the second cutter 3 is adjusted to be equivalent to the desirable cut length (the length of the image portion 13 in the conveyance direction). An exemplary arrangement of the image portion 13, the first non-image portion 12, and the second non-image portion 14 on the continuous sheet 7 is illustrated in FIG. 15A. A cutting method while the continuous sheet 7 is conveyed according to the third embodiment will be described on the basis of the state illustrated in FIG. 15A.

Referring to FIG. 15A, the continuous sheet 7 is stopped at a position at which the first non-image portion 12 located downstream of the image portion 13 can be cut and separated by the second cutter 3 and at which the second non-image portion 14 located upstream the image portion 13 can be cut and separated by the first cutter 2. While the second conveying roller pair 5 and the third conveying roller pair 6 are stopped, the image forming unit 1 continuously performs the printing, and the first conveying roller pair 4 continuously perform the conveyance.

While the second conveying roller pair 5 and the third conveying roller pair 6 are stopped, the first cutter 2 and the second cutter 3 simultaneously perform the cutting, so that the first non-image portion 12 and the second non-image portion 14 are separated from the image portion 13. FIG. 15B illustrates a sag (loop) generated during the above situation.

The sag is generated at a position located upstream of the second conveying roller pair 5. A sag length (loop length) is equivalent to a conveyed distance by the first conveying roller pair 4 while the second conveying roller pair 5 is stopped during the cutting. The generated sag is eliminated when the second conveying roller pair 5 is rotated at a high speed after the cutting is ended. A conveyance speed Vh of the second conveying roller pair 5 at this time has to be at least a speed that allows the sag to be eliminated before the second non-image portion 14 reaches the first cutter 2. This is provided as a conditional expression that establishes the third embodiment. Also, after the cutting, the third conveying roller pair 6 conveys the sheet at a rotation speed that is equal to or higher than a speed of the second conveying roller pair 5 that is eliminating the sag.

The second embodiment may be combined with the third embodiment. A conditional expression to which the second and third embodiments are applicable is given below. A sag length (loop length) formed during the cutting is as follows:

$$Tc \times Va \quad (26).$$

A time required for elimination of the sag is as follows:

$$(\text{Sag elimination time}) = (Tc \times Va)/(Vh - Va) \quad (27).$$

A distance, by which the first conveying roller pair 4 conveys the continuous sheet 7 from the state shown in FIG. 15A to the formation of the sag is as follows:

$$Tc \times Va \quad (28).$$

A distance by which the first conveying roller pair 4 conveys the second non-image portion 14 until the elimination of the sag is as follows:

$$Va(Tc \times Va)/(Vh - Va) \quad (29).$$

In the state shown in FIG. 15B, the downstream end of a third non-image portion 27 is provided upstream of the cutting position by the first cutter 2 by a distance as follows:

$$(\text{Cut length}) + Lc \quad (30).$$

Hence, a relationship is as follows:

$$(\text{Cut length}) + Lc > Tc \times Va + Va(Tc \times Va)/(Vh - Va) \quad (31).$$

In the above expressions, Va is a conveyance speed by the first conveying roller pair 4, Tc is a stop time of the second conveying roller pair 5 during the cutting, Vh is a high conveyance speed of the second conveying roller pair 5 during elimination of the sag, Lc is a distance between the cutting position by the first cutter 2 and the cutting position by the second cutter 3, and Ly is a length of the non-image portion.

Expression 31 is a condition that the third non-image portion 27 does not reach the cutting position at the first cutter 2 even if the image portion 13 is cut from the state shown in FIG. 15A and the sag generated during the cutting is eliminated.

If the desirable cut length meets Expressions 30 and 31, the cutting method according to the third embodiment is effective because the cutting method can deal with a plurality of cut lengths as long as it satisfies conditions given below.

Conditional expressions of this embodiment is as follows:

$$\text{Cut length} \leq Lc \quad (32),$$

$$(Vh-Va)\times(\text{cut length}+Ly)/Va \geq Va\times Tc \quad (33), \text{ and}$$

$$\text{Cut length} \geq Lc+(Va2\times Tc)/(Vh-Va) \quad (34).$$

Here, Expression 32, 33, and 34 are conditions that allow the sag to be continuously eliminated.

With this embodiment, since the relative positions between the first cutting unit and the second cutting unit are accurately determined, the accuracy for the cut position can be increased irrespective of the accuracy for the conveyance of the continuous sheet. Also, an image with a small size can be cut.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-041662 filed Feb. 26, 2010, which is hereby incorporated by reference herein in its entirety.

What is claimed is:

1. An image forming apparatus comprising:

an image forming unit arranged to continuously form images on a continuous sheet;

a first conveying unit provided downstream of the image forming unit in a conveyance direction and arranged to continuously convey the continuous sheet with the images formed thereon;

a second conveying unit provided downstream of the first conveying unit in the conveyance direction and arranged to convey the continuous sheet;

a first cutting unit provided downstream of the second conveying unit in the conveyance direction and arranged to cut the continuous sheet;

a second cutting unit provided downstream of the first cutting unit in the conveyance direction and arranged to cut the continuous sheet; and a control unit having at least one sensor and a processor programmed to perform control, in response to input from the at least one sensor, such that the first cutting unit performs a first cutting operation to cut a downstream end in the conveyance direction of a first image on the continuous sheet, after the first cutting operation and at a timing determined based on a distance between the first image and a second image on the continuous sheet which is formed downstream of the first image in the conveyance direction, the second cutting unit performs a second cutting operation to cut an upstream end in the conveyance direction of the second image, the first conveying unit conveys the continuous sheet at a first conveyance speed and the second conveying unit is stopped during the first cutting operation to form a loop of the continuous sheet at a position between the first and second conveying units, and then after the first cutting operation, the second conveying unit conveys the continuous sheet at a second conveyance speed which is faster than the first conveyance speed to reduce the loop.

2. The image forming apparatus according to claim 1, further comprising a mark sensor that detects a mark that is recorded by the image forming unit, at a position between the first and second images, the mark being indicative of positional information for cutting by the first or second cutting unit.

3. The image forming apparatus according to claim 1, wherein the image forming apparatus satisfies expressions as follows, $$(Lc-Ly) \geq [Vh\times(Tc\times Va)/(Vh-Va)], \text{ and}$$

$$(Lc-Ly)/Vh+Tc(Tc\times Va)/(Vh-Va)+[(Lc-Ly)-Vh\times(Tc\times Va)/(Vh-Va)]/Va,$$

where Va is the first conveyance speed, Tc is a stop time of the second conveying unit during the cutting by the first cutting unit, Vh is the second conveyance speed, Lc is a distance between a cutting position by the first cutting unit and a cutting position by the second cutting unit, and Ly is a distance between the downstream end of the first image and the upstream end of the second image.

4. The image forming apparatus according to claim 1, wherein the image forming unit performs recording by discharging ink.

5. The image forming apparatus according to claim 1, wherein the continuous sheet has a thickness of 100 μm or larger.

6. The image forming apparatus according to claim 1, wherein the first cutting unit includes a first blade that contacts a first surface of the continuous sheet with an image formed thereon and a second blade that contacts a second surface of the continuous sheet which is a back side of the first surface, wherein when the first blade engages with the second blade, the second blade is located upstream of the first blade in the conveyance direction, wherein the second cutting unit includes a third blade that contacts the first surface of the continuous sheet and a fourth blade that contacts the second surface of the continuous sheet, and wherein when the third blade engages with the fourth blade, the fourth blade is located downstream of the third blade in the conveyance direction.

7. A cutting device comprising:

a first conveying unit arranged to continuously convey a continuous sheet with images formed thereon;

a second conveying unit provided downstream of the first conveying unit in a conveyance direction and arranged to convey the continuous sheet;

a first cutting unit provided downstream of the second conveying unit in the conveyance direction and arranged to cut the continuous sheet;

a second cutting unit provided downstream of the first cutting unit in the conveyance direction and arranged to cut the continuous sheet; and a control unit having at least one sensor and a processor programmed to perform control, in response to input from the at least one sensor, such that the first cutting unit performs a first cutting operation to cut a downstream end in the conveyance direction of a first image on the continuous sheet, after the first cutting operation and at a timing determined based on a distance between the first image and a second image on the continuous sheet which is formed downstream of the first image in the conveyance direction, the second cutting unit performs a second cutting operation to cut an upstream end in the conveyance direction of the second image, the first conveying unit conveys the continuous sheet at a first conveyance speed and the second conveying unit is stopped during the first cutting operation to form a loop of the continuous sheet at a position between the first and second conveying units, and then after the first cutting operation, the second conveying unit conveys the continuous sheet at a second conveyance speed which is faster than the first conveyance speed to reduce the loop.

* * * * *